US007887016B2

(12) United States Patent
Gunsaullus

(10) Patent No.: US 7,887,016 B2
(45) Date of Patent: Feb. 15, 2011

(54) ALL TERRAIN MATERIAL AND TOOL TRAY

(76) Inventor: Scott E. Gunsaullus, 348 W. Prairie Cir., Itasca, IL (US) 60143

( * ) Notice: Subject to any disclaimer, the term of this patent is extended or adjusted under 35 U.S.C. 154(b) by 845 days.

(21) Appl. No.: 11/843,778

(22) Filed: Aug. 23, 2007

(65) Prior Publication Data

US 2009/0050761 A1 Feb. 26, 2009

(51) Int. Cl.
*A47G 29/02* (2006.01)

(52) U.S. Cl. ..... 248/238; 248/239; 248/242; 248/393; 182/2.1; 182/2.2; 108/152; 206/373

(58) Field of Classification Search ..... 248/210, 248/211, 241, 242, 243, 245, 244, 239, 235, 248/250, 371, 393, 394, 396, 397, 148, 240, 248/398, 454, 455, 456, 457, 238; 182/2.1, 182/2.2, 45, 126, 124, 125, 129; 108/152, 108/97, 50.1, 16, 135, 61; 206/373, 372
See application file for complete search history.

(56) References Cited

U.S. PATENT DOCUMENTS

| | | | | | |
|---|---|---|---|---|---|
| 630,734 | A | * | 8/1899 | Oothout | 248/154 |
| 677,566 | A | * | 7/1901 | Eaton | 410/68 |
| 1,408,253 | A | * | 2/1922 | Blank | 280/32.5 |
| 1,471,947 | A | * | 10/1923 | Cornelius | 182/45 |
| 2,006,580 | A | * | 7/1935 | Broun | 248/454 |
| 2,308,180 | A | * | 1/1943 | Larsen et al. | 248/238 |
| 2,982,982 | A | * | 5/1961 | Swift, Sr. | 15/257.06 |
| 3,625,388 | A | * | 12/1971 | Golden et al. | 220/570 |
| 3,642,239 | A | * | 2/1972 | Zeiler, Jr. | 248/210 |
| 3,642,240 | A | | 2/1972 | Hershey | |
| 4,071,163 | A | * | 1/1978 | Martin | 220/630 |
| 4,120,472 | A | | 10/1978 | Balne | |
| 4,212,371 | A | | 7/1980 | Gaviorno, Jr. | |
| 4,458,783 | A | * | 7/1984 | Stakes | 182/206 |
| 4,480,810 | A | | 11/1984 | Hall | |
| 4,618,030 | A | | 10/1986 | Campbell | |
| 4,624,430 | A | | 11/1986 | Ehmke | |
| 4,695,023 | A | * | 9/1987 | McCafferty | 248/238 |
| 4,702,446 | A | | 10/1987 | Brown | |
| 4,787,478 | A | * | 11/1988 | Stakes, Jr. | 182/206 |
| 4,795,180 | A | | 1/1989 | Polcyn | |
| 4,890,807 | A | | 1/1990 | Desjardins | |
| 4,899,970 | A | | 2/1990 | Berzina | |
| 4,998,696 | A | | 3/1991 | Desjardins | |
| 5,217,193 | A | * | 6/1993 | Drucker | 248/148 |
| D341,958 | S | * | 12/1993 | Allred | D6/406.4 |
| 5,460,241 | A | | 10/1995 | LaBelle | |
| 5,547,080 | A | | 8/1996 | Klimas | |
| 5,570,864 | A | * | 11/1996 | Flores | 248/148 |
| 5,601,036 | A | * | 2/1997 | Kieser et al. | 108/107 |
| 5,615,752 | A | * | 4/1997 | Wassil | 182/200 |
| 5,622,278 | A | | 4/1997 | Fries et al. | |
| 5,727,649 | A | | 3/1998 | Buckley | |
| D397,229 | S | | 8/1998 | Winters et al. | |

(Continued)

*Primary Examiner*—Kimberly T Wood
(74) *Attorney, Agent, or Firm*—Mathew R. P. Perrone, Jr.; Brie A. Crawford

(57) ABSTRACT

A reinforced all terrain material and tool tray, having an articulating shelf assembly mounted on an articulating base assembly in order to improve access to construction material such as paint or tools, can be used on a roof, the ground, or on ladder, with or without the ladder shelf.

12 Claims, 20 Drawing Sheets

U.S. PATENT DOCUMENTS

| | | | | |
|---|---|---|---|---|
| 5,855,346 | A | 1/1999 | Hall | |
| 5,934,627 | A * | 8/1999 | Lewis et al. | 248/148 |
| 5,941,344 | A | 8/1999 | Spadaro | |
| 5,967,259 | A | 10/1999 | Williams | |
| 6,082,689 | A * | 7/2000 | Bushway | 248/237 |
| 6,145,800 | A * | 11/2000 | Watkins | 248/461 |
| 6,425,567 | B2 * | 7/2002 | Schutze | 248/452 |
| 6,443,260 | B1 * | 9/2002 | Katz et al. | 182/129 |
| D484,251 | S | 12/2003 | Pruett et al. | |
| 6,732,480 | B1 * | 5/2004 | Smith et al. | 52/126.1 |
| 6,742,747 | B1 * | 6/2004 | Timmons, Jr. | 248/139 |
| 6,966,406 | B2 * | 11/2005 | Nash, Jr. | 182/122 |
| 7,077,238 | B2 | 7/2006 | Butler et al. | |
| D542,034 | S | 5/2007 | Romano | |
| 2002/0017430 | A1 * | 2/2002 | Rosko | 182/129 |
| 2002/0027091 | A1 * | 3/2002 | Brown | 206/372 |
| 2004/0217242 | A1 | 11/2004 | Foreman | |
| 2005/0056486 | A1 | 3/2005 | Butler et al. | |
| 2006/0219586 | A1 * | 10/2006 | Phillips | 206/373 |
| 2006/0226310 | A1 * | 10/2006 | Hall et al. | 248/148 |
| 2009/0095567 | A1 * | 4/2009 | Rinna | 182/124 |

* cited by examiner

ALL TERRAIN MATERIAL AND TOOL TRAY

This invention relates to a material and tool tray and more particularly to a portable all terrain material and tool tray, which may be used on a ladder, on a roof, on the ground; or easily mounted on or removed from a ladder; and which provides paint tools, or other implements at a desired angle.

BACKGROUND OF THE INVENTION

Many times, it is very desirable to provide tools, paint or other materials in a working situation. Not only must the materials be properly and safely held, they must be accessible for work. This can be a difficult problem in balancing the security and accessability conflict.

Painting or other work in construction of a building is complicated in that become necessary to use a ladder. When one is on a ladder, there must still be good access to tools, paint or material. There must be an appropriate way to place any desired material within a proper reach of the person doing the work on the ladder, because reaching work or tools from a ladder is limited for safety reasons. Such a requirement can lead to a variety of devices. None of the existing devices can effectively solve that problem.

A ladder usually has a shelf, on which the desired material may be placed. This shelf usually offers one position. That leaves the person on the ladder adjusting to that one position, when accessing the materials being used. Such materials include, but are not limited, paint and paint equipment, and tools required to work on the area around the ladder. Clearly, such a limited position for these materials cannot be effective in all situations. Yet adjustment of that position is extremely difficult.

That shelf is the weakest and the most vulnerable part of the ladder. It is quite common for that shelf to break off of the ladder. Replacement thereof is expensive, with a great possibility of that shelf breaking again. To replace that broken shelf with a stronger or sturdier device can be of great advantage. Combining that strength with more flexibility as to a usable position increases the advantages for that device. Yet such a device is not in the prior art. It thus becomes desirable to permit a ladder to hold tools or paint in a desired position for efficient use with an appropriate device. Furthermore, it is very useful to adjust that device to a desired or more useful or more accessible angle. Such angles can make the work much more efficient. This efficiency is very desirable.

Adjusting devices of the prior art tend to be complicated in both use and attachment to the ladder. If the device is easily attached to a ladder, adjustment is compromised. If its adjustment is simplified, the ladder attachment thereof becomes more complicated.

Thus, it is very desirable to provide an easily adjustable device to be attached to ladder. This device must also be easily adjusted appropriately to provide a good work area. These functions are contraindicated. As one is maximized, the other is compromised. Yet, maximization for the advantages of both, can solve many problems in the art, especially the construction arts.

SUMMARY OF THE INVENTION

Among the many objectives of the present invention is the provision of a reinforced all terrain material and tool tray easily mounted on a ladder.

Another objective of the present invention is the provision of an all terrain material and tool tray, which is easily adjusted.

Yet another objective of the present invention is the provision of an all terrain material and tool tray to position a paint container for use.

Still, another objective of the present invention is the provision of an all terrain material and tool tray to position a tool container for use.

Also, an objective of the present invention is the provision of an all terrain material and tool tray to replace a ladder shelf.

A further objective of the present invention is the provision of an all terrain material and tool tray to mount on a ladder shelf.

A still further objective of the present invention is the provision of an all terrain material and tool tray to use on a roofing project.

These and other objectives of the invention (which other objectives become clear by consideration of the specification, claims and drawings as a whole) are met by providing a reinforced all terrain material and tool tray, having an articulating shelf assembly mounted on an articulating base assembly in order to improve access to construction material such as paint or tools.

BRIEF DESCRIPTION OF DRAWINGS

Throughout the figures of the drawings, where the same part appears in more than one figure of the drawings, the same number is applied thereto.

DESCRIPTION OF THE PREFERRED EMBODIMENTS

The all terrain material and tool tray of this invention has an articulating base assembly, which firmly supports any implement or material being used in a desired position. This all terrain material and tool tray can be used in roofing or painting or other construction projects. The articulating base assembly permits whatever is supported on articulating shelf assembly to be put at a desired angle relative to the articulating base assembly. Such positioning can facilitate use of fluids or access to tools. So the all terrain material and tool tray can position such material or implement in the most desired accessible position. It is especially usefully in setting a bucket or pail of a construction fluid, such as paint, at a desired angle for the most efficient use.

The all terrain material and tool tray of this invention provides an appropriate device for use on a work surface. Typical work surfaces include, but are not limited to a ladder, a roof, a ground surface, or other desired surface. It includes an articulating shelf assembly for holding a container, such as a bucket or a paint can. The bucket can support tools, paint, roofing material or desired material. Such uses for this all terrain material and tool tray on a ladder, on a roof, on the ground, or in another position are as varied as the imagination of a user. The ladder is preferably a step ladder.

Clearly, the all terrain material and tool tray can support at least one useful implement, such as a paint can, at least one tool or other required implement on a roof or a ladder. That at least one useful implement can be positioned for efficient use by an appropriate adjustment of the all terrain material and tool tray. As useful implement is positioned, it becomes more accessible to the worker. Such improved accessability to any implement increases the worker's efficiency and provides additional comfort for the worker.

This all terrain material and tool tray is especially useful if painting is the project. With the all terrain material and tool tray, the paint can or other holder of paint can be adjusted to the desired angle, in order to greatly facilitate viewing the contents of the can or reaching paint supply with the desired applicator in the desired fashion. The chance over dipping the paint brush or the roller is greatly reduced. So this all terrain material and tool tray may be used if the painter is working from the ground or from the ladder.

Additionally, the all terrain material and tool tray is useful in a roofing project, because it compensates for the pitch of a roof. Paint and tools material for a project on a roof is made more accessible. The sealing material may be plumb, due to the positioning mechanism, in spite of the varied pitches of different roofs. So roofing material becomes more accessible with the all terrain material and tool tray too.

Figure 1:
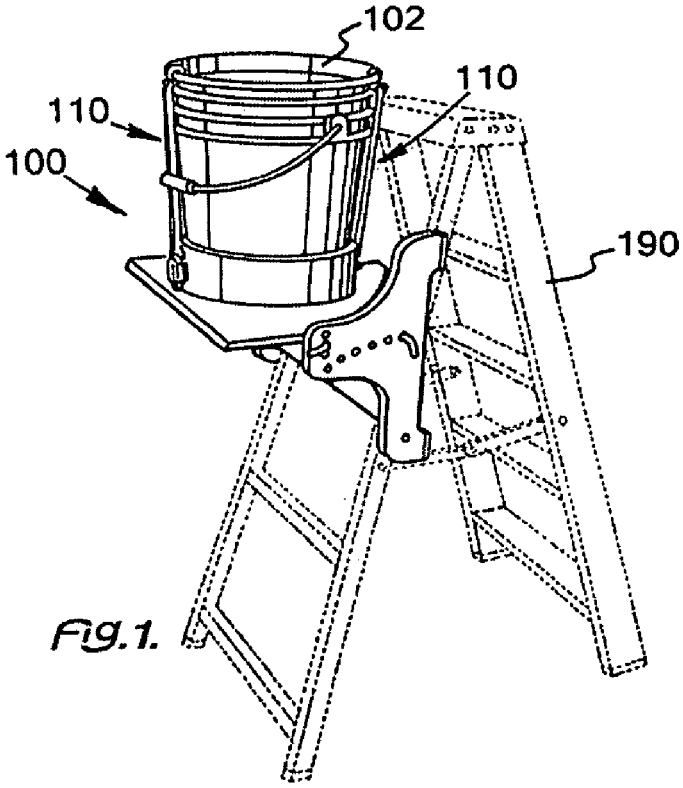
FIG. 1 depicts a perspective view of the reinforced all terrain material and tool tray 100 of this invention mounted on a ladder 190.

Referring now to FIG. 1, all terrain material and tool tray 100 is mounted on a ladder 190. To the all terrain material and tool tray 190 is secured a bucket 102. Bucket 102 may contain paint, tools or other desired implements for working. Bungee assembly 110 secures bucket 102 to the all terrain material and tool tray 100. All terrain material and tool tray 100 permits bucket 102 to be placed in a series of different angled positions and improve access to the contents of a bucket by a worker.

Figure 2:
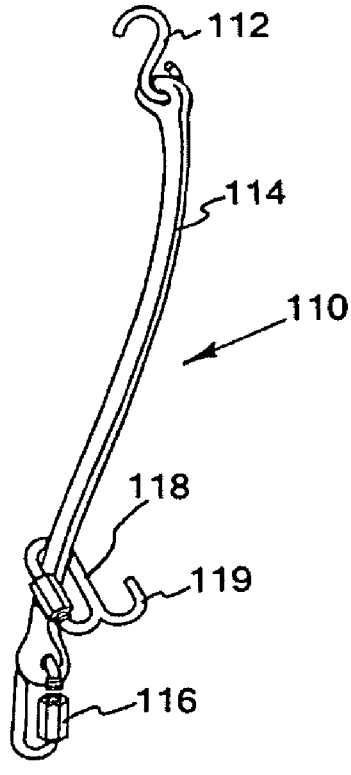
FIG. 2 depicts a perspective view of bungee assembly 110 for use with the reinforced all terrain material and tool tray 100 of this invention.
Figure 3:
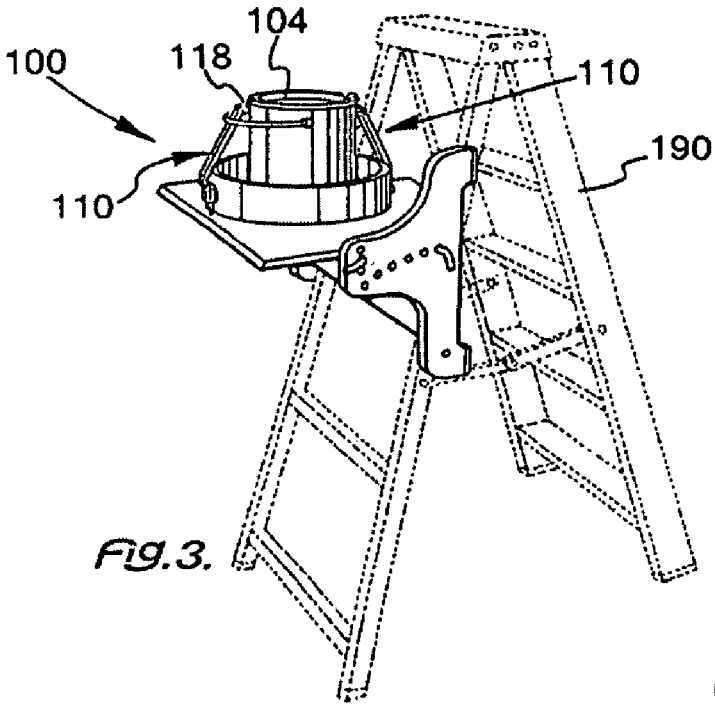
FIG. 3 depicts a perspective view of the all terrain material and tool tray 100 of this invention holding a paint can 104.
Figure 4:
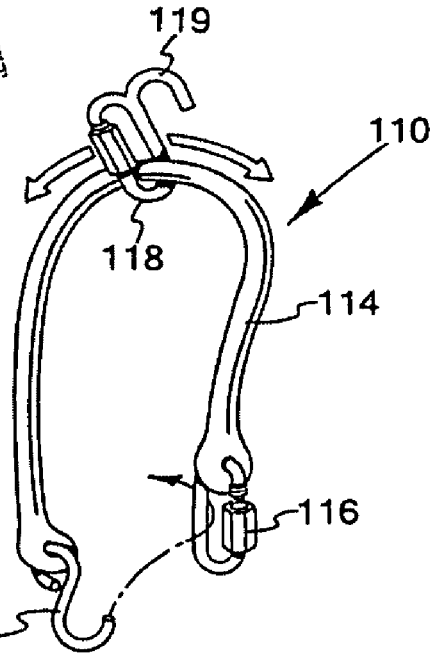
FIG. 4 depicts a perspective view of bungee assembly 110 for use with the all terrain material and tool tray 100 of this invention.

Adding FIG. 2, FIG. 3 and FIG. 4 to the consideration, the use of bungee assembly 110 to hold bucket 102 (FIG. 1) in place on all terrain material and tool tray 100 becomes clear.

Bungee assembly 110 has S-hook 112 at one end of bungee strap 114 with a plain locking link 116 at the other end thereof. Between a S-hook 112 and locking link 116, a hooked locking link 118 slides along bungee strap 114. Hooked member 119 acts as a securing device for all terrain material and tool tray 100.

The end S-hook 112 fits into locking link 116 as locking link 116 is secured all terrain material and tool tray 100. The sliding or adjustable hooked locking link 118 attaches to paint can 104 or other desired point. A second bungee assembly 110 attaches to the all terrain material and tool tray 100, but is preferably diametrically opposed to first bungee assembly 110. Thus, paint can 104 is firmly held on all terrain material and tool tray 100.

FIG. 3 is very similar to FIG. 1, except that pail 104 replaces bucket 102. Still, all terrain material and tool tray 100 holds pail 104 as sturdily as bucket 102. Access to pail 104 is as good as access to bucket 102, thanks to all terrain material and tool tray 100. The hooked locking link 118 attaches pail 104 as well as bucket 102 to all terrain material and tool tray 100. Pail 104 generally has a smaller capacity relative to bucket 102.

Figure 5:
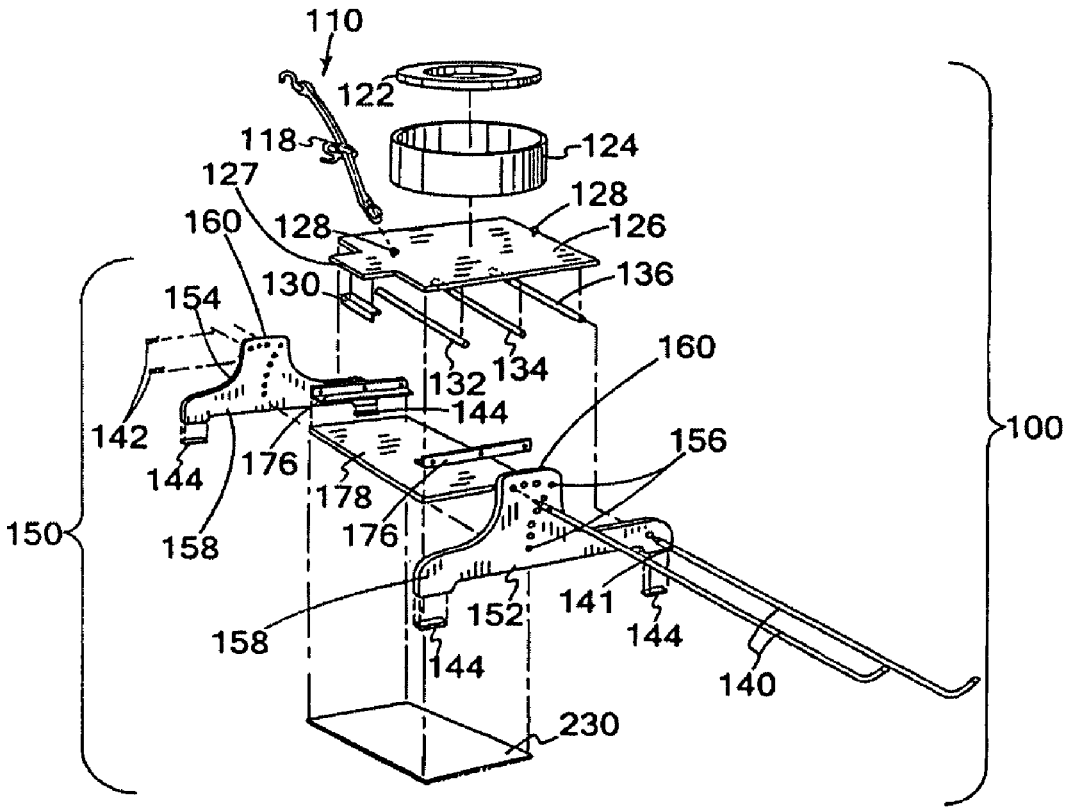
FIG. 5 depicts an exploded, perspective view of the all terrain material and tool tray 100 of this invention.

With the addition of FIG. 5 to the consideration, the structure of all terrain material and tool tray 100 becomes even more clear. The articulating base assembly 150 includes a can collar 122 surrounded by a bucket collar 124 and secured to a shelf panel 126. On shelf panel 126 is also mounted a pair of eyelets 128 in a position to mount two of bungee assembly 110 in a preferably diametrically opposed parameter.

Shelf panel 126 is generally rectangular in shape with a rectangular cleat panel 127 extending therefrom. The rectangular cleat panel 127 has smaller sides than shelf panel 126. A ladder cleat 130 is secured to cleat panel 127 on the oppositely disposed side relative to eyelets 128. A cleat side pin sleeve 132 is secured to shelf panel 126 adjacent to ladder cleat 130. Adjacent to cleat side pin sleeve 132, is secured a center pin sleeve 134. Adjacent center pin sleeve 134 is outboard pin sleeve 136.

Articulating base assembly 150 includes a left panel 152 and a right panel 154. Between left panel 152 and right panel 154 is support base 178. Support base 178 is secured therebetween using angle brackets 176. Left panel 152 and right panel 154 are similar in shape, in fact preferably being substantially a mirror image of each other. Each has a footed portion 158 and a raised portion 160.

The footed portion 158 is adjacent to support base 178 while raised portion 160 includes a series of pin apertures 156. Each of the series of pin apertures 156 in left panel 152 has a matching or congruent aperture 156 in right panel 154, to cooperate with hinge pin 140 for proper positioning. In a preferred form the series of pin apertures 156 in left panel 152 or right panel 154 form the outline of the arabic numeral seven.

As the footed portion 158 is used, it is possible and sometimes desirable to place a rubber pad 144 on the bottom thereof. This structure shows four of rubber pad 144 being used, in order to facilitate placing of all terrain material and tool tray 100, in a desired position.

Left panel 152 and right panel 154 are secured on opposing sides of support base 178 with angle brackets 176 by using appropriate fastener; such as screws, or nuts and bolts. Left panel 152 and right panel 154 are similar in shape. If desired, a gripping rubber pad 230 is secured to support base 178. Rubber pad 230 reduces a sliding factor for all terrain material and tool tray 100 and simplifies the mounting thereof on a desired surface.

Figure 6:
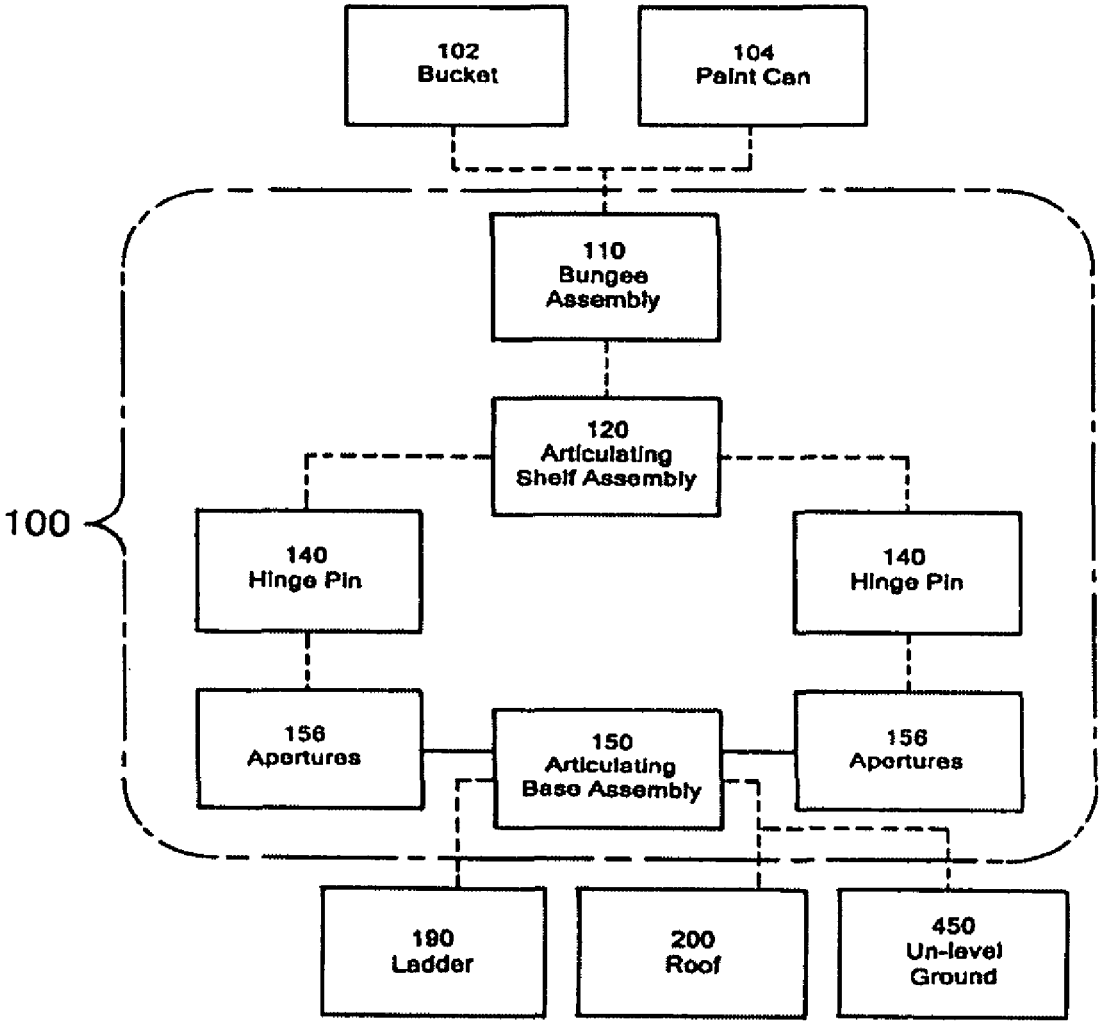
FIG. 6 depicts a general box diagram for the all terrain material and tool tray 100 of this invention.
Figure 7:
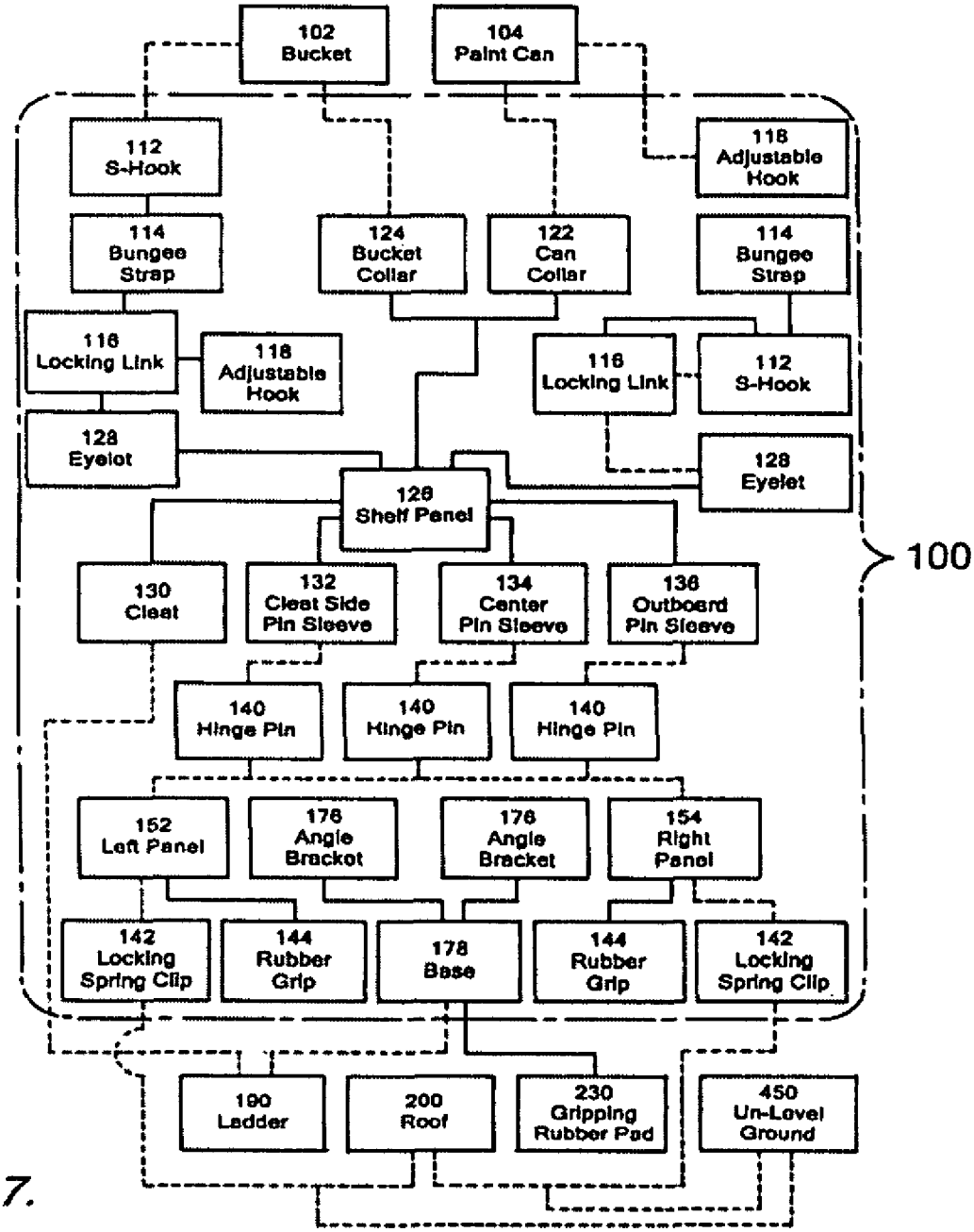
FIG. 7 depicts a detailed box diagram for the all terrain material and tool tray 100 of this invention.
Figure 8:
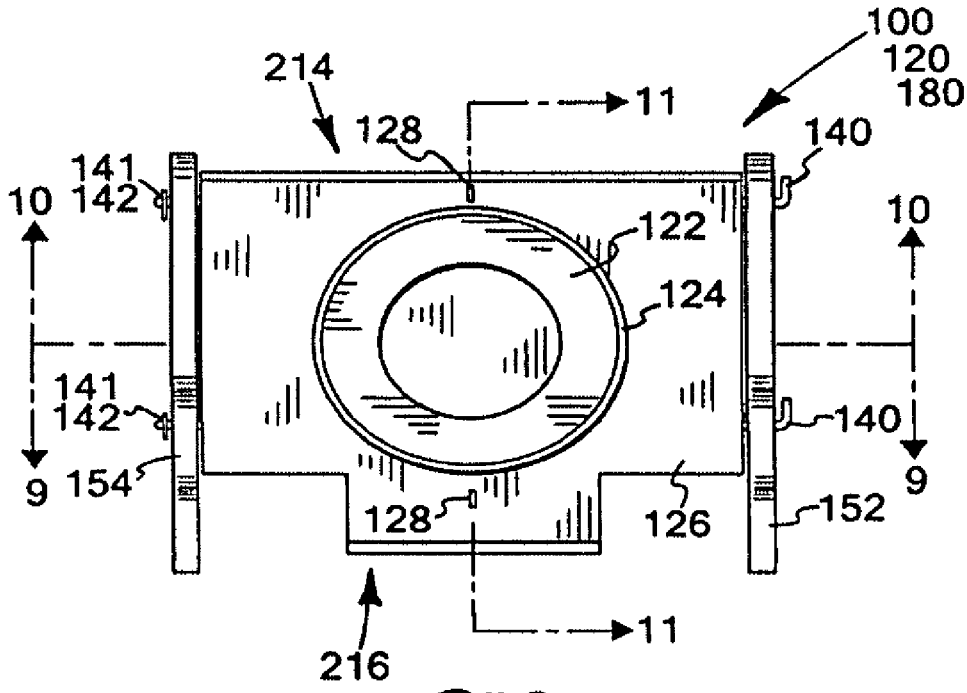
FIG. 8 depicts a top plan view for the all terrain material and tool tray 100 of this invention.
Figure 9:
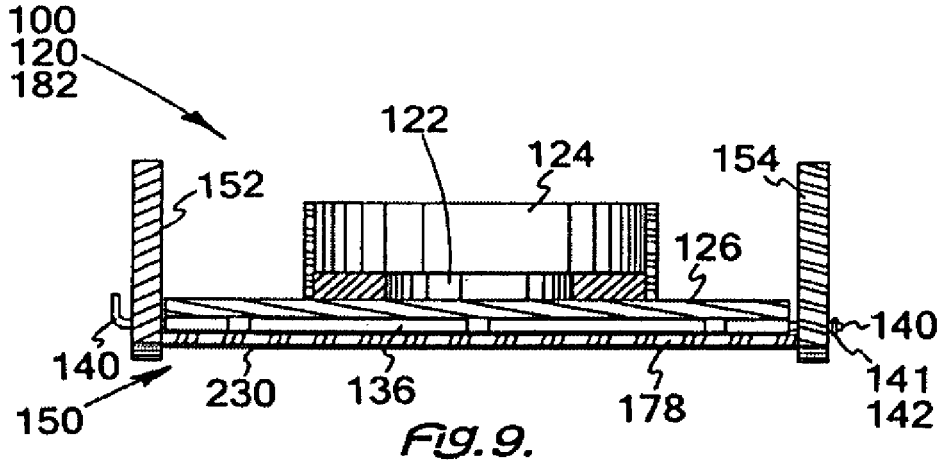
FIG. 9 depicts a cross-section of the all terrain material and tool tray 100 of this invention, based on FIG. 8, along Line 9-9.
Figure 10:
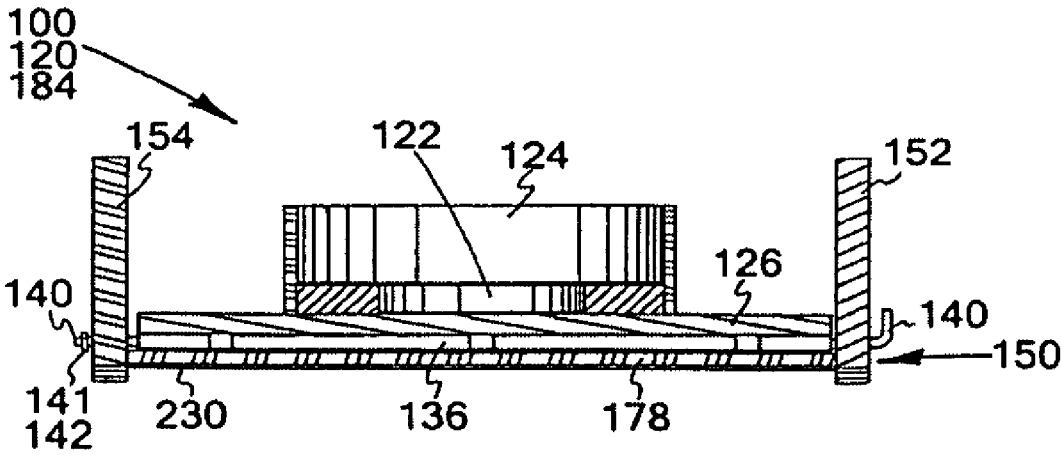
FIG. 10 depicts a cross-section of the all terrain material and tool tray 100 of this invention, based on FIG. 8, along Line 10-10.
Figure 11:
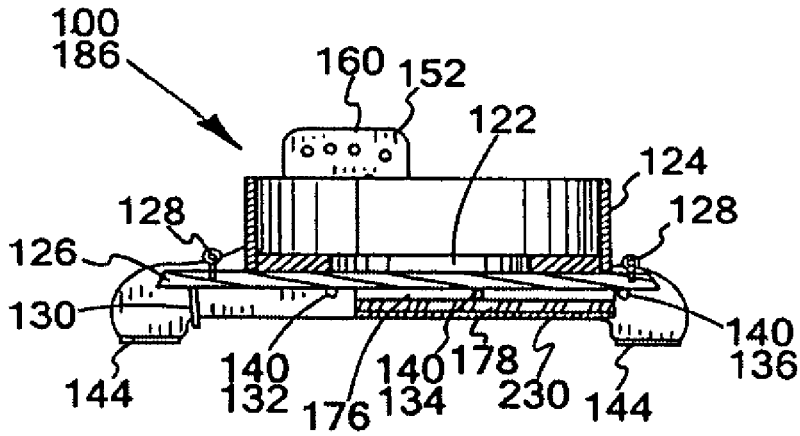
FIG. 11 depicts a partial cross-section of the all terrain material and tool tray 100 of this invention, based on FIG. 8, along Line 11-11.
Figure 12:
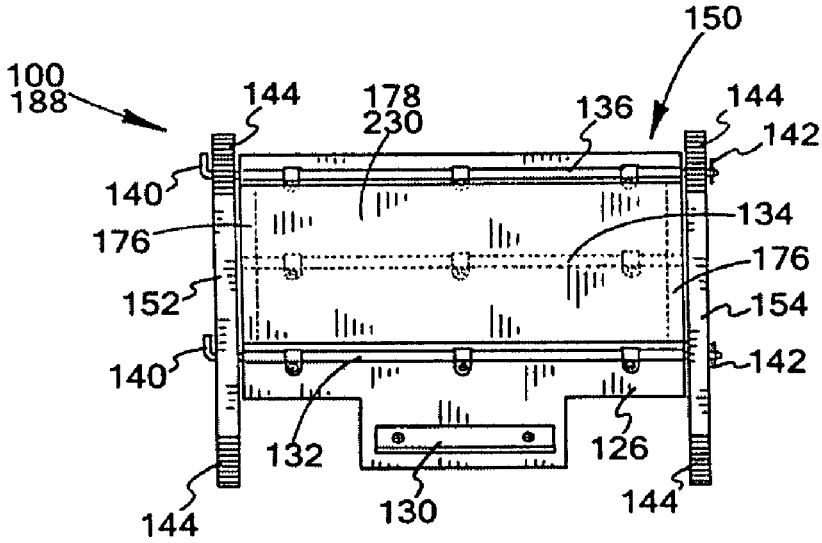
FIG. 12 depicts a bottom plan view for the all terrain material and tool tray 100 of this invention.
Figure 13:
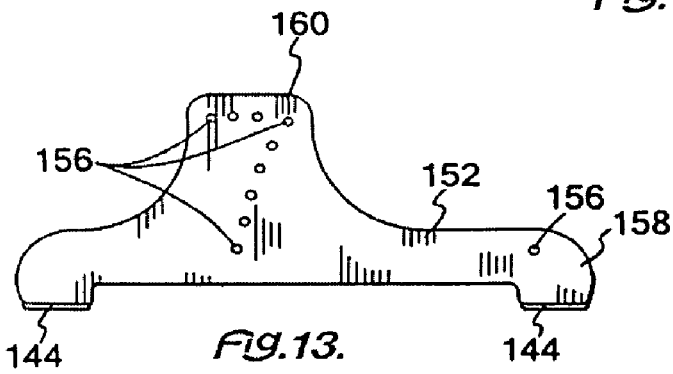
FIG. 13 depicts a side view of left panel 152 for the all terrain material and tool tray 100 of this invention.
Figure 14:
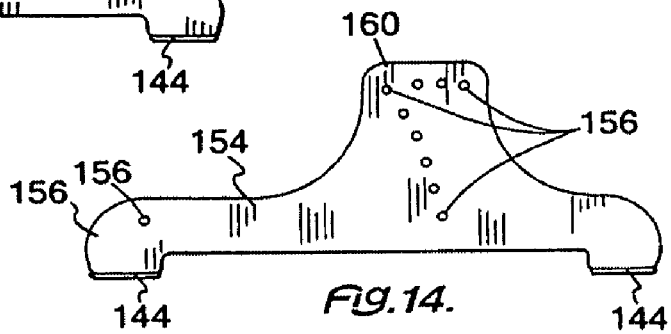
FIG. 14 depicts a side view of right panel 154 for the all terrain material and tool tray 100 of this invention.

Adding FIG. 6 and FIG. 7 to the consideration, each of hinge pin 140 cooperates with cleat side pin sleeve 132, center pin sleeve 134 or outboard pin sleeve 136, In this manner, the articulating shelf assembly 120 can be positioned as desired relative to articulating base assembly 150. This cooperation between articulating shelf assembly 120 and articulating base assembly 150 permits efficient painting or tool use, especially in construction work.

In a preferred fashion, a painting bucket 102 or paint can 104 may be placed on an angle by the all terrain material and tool tray 100, so that a painter (not shown) can see into either one without stretching. This feature makes it easier for the painter to take up paint, stain or other material onto a brush, a roller or other implement in an appropriate fashion.

As can be seen from FIG. 6, all terrain material and tool tray 100 includes an articulating shelf assembly 120, which is connected to articulating base assembly 150 by two hinge pins 140. A plurality of hinge pin apertures 156 permit the placement of articulating shelf assembly 120 relative to articulating base assembly 150. A pair of hinge pins 140 cooperate with apertures 156 and permit all terrain material and tool tray 100 to be used on a ladder 190 or a roof 200. With bungee assembly 110 added in either bucket 102 or paint can 104 can be supported.

For painting, an angle of the paint supply, whether in bucket 102 or paint can 104 is usually preferred, in order to see the paint supply more easily. On the other hand, for roof work, a horizontal or level situation is usually required for the roofing materials in order to compensate for the pitch or the slope of the roof.

FIG. 7 expands on FIG. 6 in order to further clarify the structure of all terrain material and tool tray 100. The parts of both articulating shelf assembly 120 and articulating base assembly 150 are defined. Also, the interrelation of articulating shelf assembly 120 and articulating base assembly 150 are defined.

In articulating shelf assembly 120, shelf panel 126 receives a bucket collar 124. Since bucket 102 generally is larger than can 104, can collar 122 fits inside of bucket collar 124. Adjacent to bucket collar 124 on shelf panel 126, is a pair of diametrically opposed eyelets 128. Each eyelet 128 may receive a locking link 116 on bungee strap 114. As fixed S-hook 112 fits locking link 116 sliding or hooked locking link 118 joins to bucket 102 or pail 104 desired. With bucket collar 124 or can collar 122, the desired can 104 or bucket 102 are secured to all terrain material and tool tray 100.

The shelf panel 126 has the ladder cleat 130 mounted on the under side thereof, while bucket collar 124 is mounted on the topside thereof. Adjacent to cleat 130 is a cleat side pin sleeve 132. Adjacent to cleat side pin sleeve 132 is center pin sleeve 134. Adjacent to center pin sleeve 134, is outboard pin sleeve 136. Cleat side pin sleeve 132, center pin sleeve 134, and outboard pin sleeve 136 are substantially and mutually parallel.

Cooperating with articulating shelf assembly 120 in general and shelf panel 126 in particular, is articulating base assembly 150. For articulating base assembly 150 connecting to shelf panel 126 is accomplished by hinge pins 140. Each hinge pin 140 passes through left panel 152; through one of cleat side pin sleeve 132, center pin sleeve 134 or outboard pin sleeve 136; and into right panel 154. The opposing procedure will work also.

A first angle bracket 176 secures left panel 152 to one side of support base member 178, while a second bracket 176 secures right panel 154 to an opposing side of support base member 178. The assembly of articulating base assembly 150 and articulating shelf assembly 120 cooperate for use on a ladder 190 or a roof 200.

Adding FIG. 8, FIG. 9, FIG. 10, FIG. 11, FIG. 12, FIG. 13, and FIG. 14 to the consideration, the assembly of all terrain material and tool tray 100 is shown. Left panel 152 and right panel 154 have a series of apertures 156. Preferably, each aperture 156 in the series of apertures 156 forms the outline of an Arabic numeral seven. Each aperture 156 in right panel 154 has a congruent aperture 156 in left panel 152. The congruent apertures 156 receive a hinge pin 140 which passes through one of the desired cleat side pin sleeve 132, center pin sleeve 134 or outboard pin sleeve 136.

Each hinge pin 140 has a bent end 138 and a straight end 135. At the straight end is a spring clip aperture 141. Through aperture 141 can be inserted a locking spring clip 142, which cooperates with bent end in order to prevent the leaving of pin sleeve 132, center pin sleeve 134 or outboard pin sleeve 136 (FIG. 15) of hinge pin 140, until removal is desired.

Each pair of congruent apertures 156 permit articulating shelf assembly 120 to be positioned relative to articulating base assembly 150, and provide a desired angle for bucket 104 or paint can 102. This is effective whether all terrain material and tool tray 100 is used on ladder 190 or roof 200. Can collar 122 fits inside bucket collar 124 and has a can aperture 158 to receive can 104.

Bungee assembly 110 cooperates with eyelets 128 to secure can 104 or bucket 102 as desired. Both paint can 104 or bucket 102 can receive and support liquids or solids. Liquids can be anything, but are preferably paint, stain or similar liquids. Solids can be anything, but are preferably desired tools.

Figure 15:
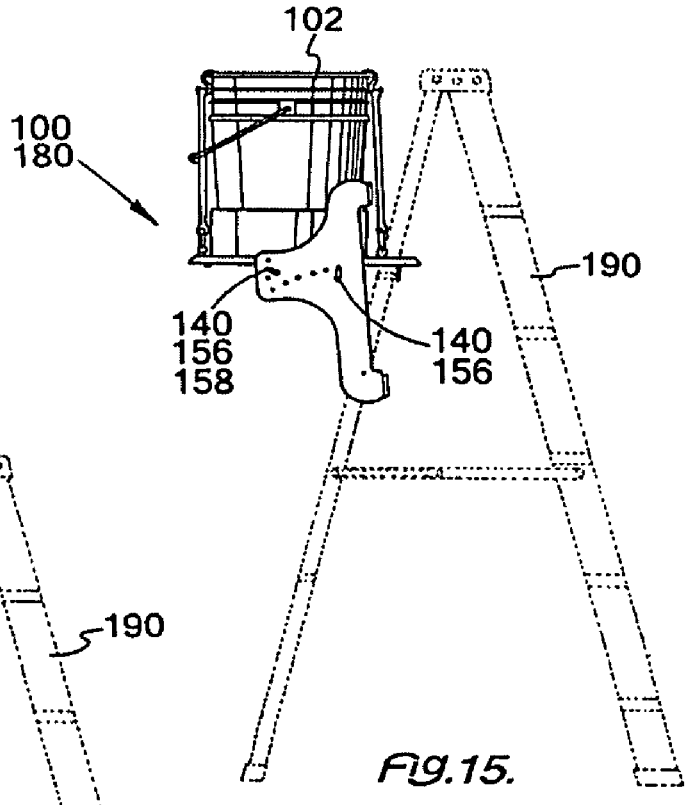
FIG. 15 depicts a side view of the all terrain material and tool tray 100 on ladder 190 of this invention in plumb position 180.
Figure 16:
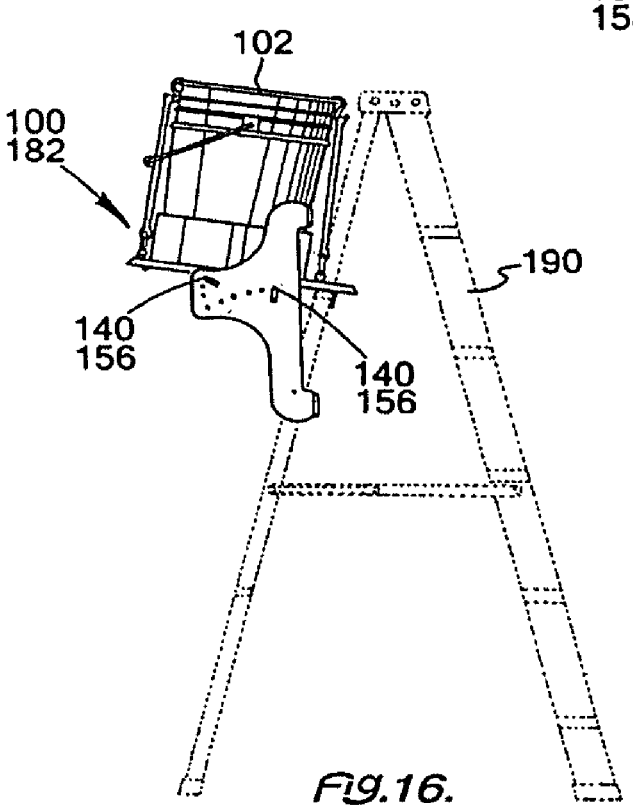
FIG. 16 depicts a side view of the all terrain material and tool tray 100 on ladder 190 of this invention in pitched position 182.

FIG. 15 and FIG. 16 combine to show all terrain material and tool tray 100 in position on a ladder 190, when a person desires to paint from ladder 190. Two of hinge pin 140 are positioned in different pairs of congruent apertures 156; and in two of cleat side pin sleeve 132, center pin sleeve 134 or outboard pin sleeve 136. Then bucket 102, as well as paint can 104 (FIG. 6), can be positioned at a desired angle. Horizontal or plumb position 180 as shown in FIG. 15 is desired when bucket 102 is full. Angled or pitched positions 82 as shown in FIG. 16 gives better viewing when the bucket 102 is not full.

Figure 17:
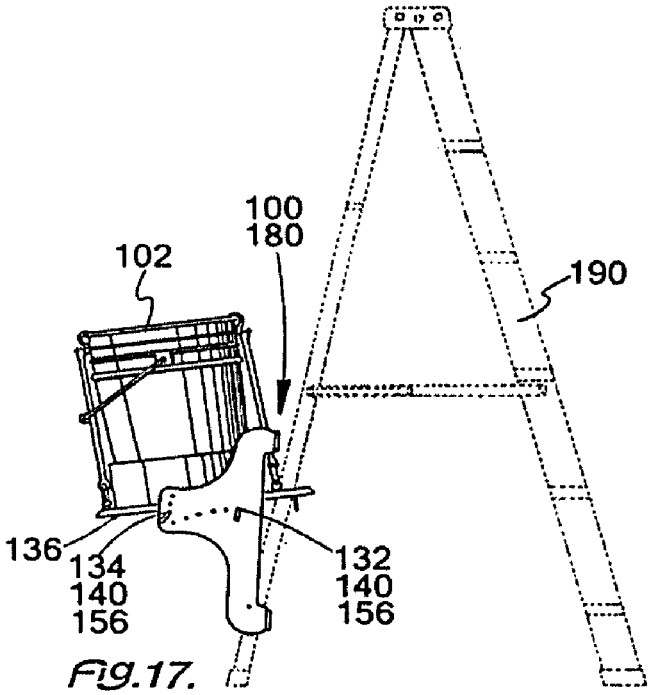
FIG. 17 depicts a side view of the all terrain material and tool tray 100 on ladder 190 of this invention in plumb position 180 on ground level 184.
Figure 18:
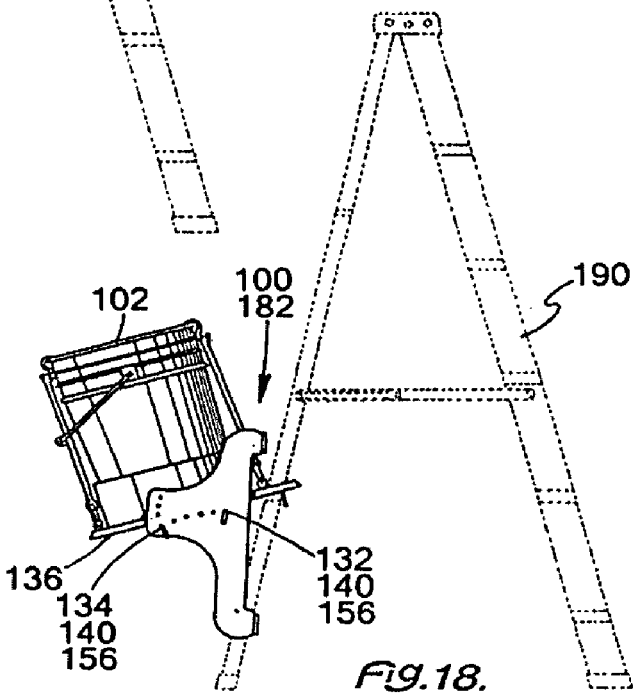
FIG. 18 depicts a side view of the all terrain material and tool tray 100 on ladder 190 of this invention in pitched position 182 on ground level 184.
Figure 19:
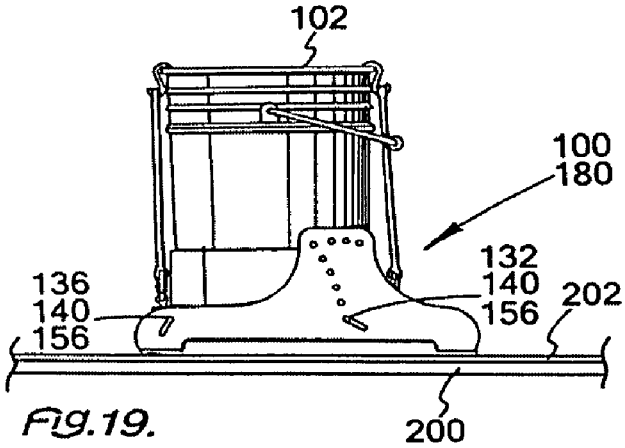
FIG. 19 depicts a side view of the all terrain material and tool tray 100 of this invention on a roof 200 in plumb position 180.
Figure 20:
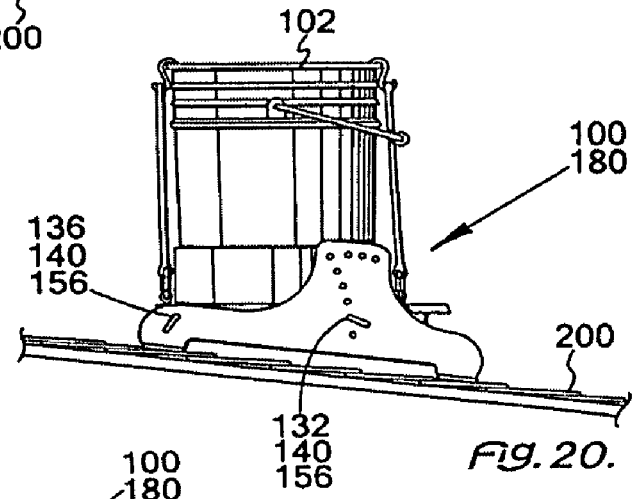
FIG. 20 depicts a side view of the all terrain material and tool tray 100 of this invention on a second roof 200 in plumb position 180.
Figure 21:
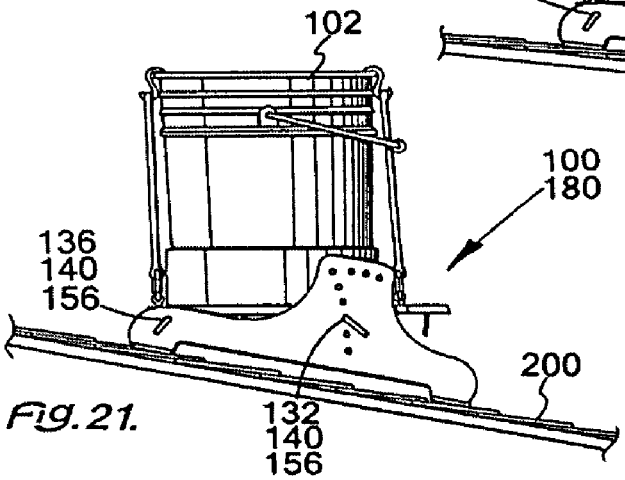
FIG. 21 depicts a side view of the all terrain material and tool tray 100 of this invention on a third roof 200 in plumb position 180.
Figure 22:
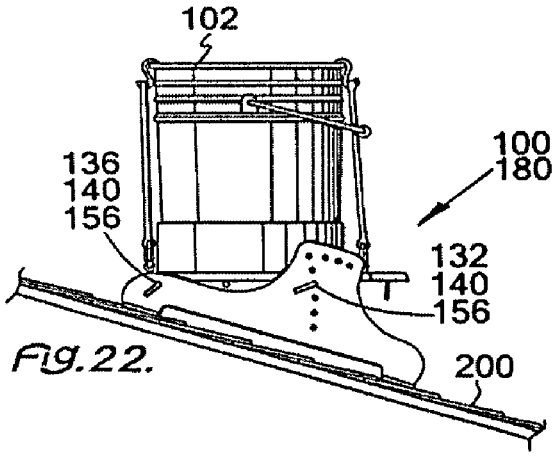
FIG. 22 depicts a side view of the all terrain material and tool tray all terrain material and tool tray 100 of this invention on a fourth roof 200 in plumb position 180.
Figure 23:
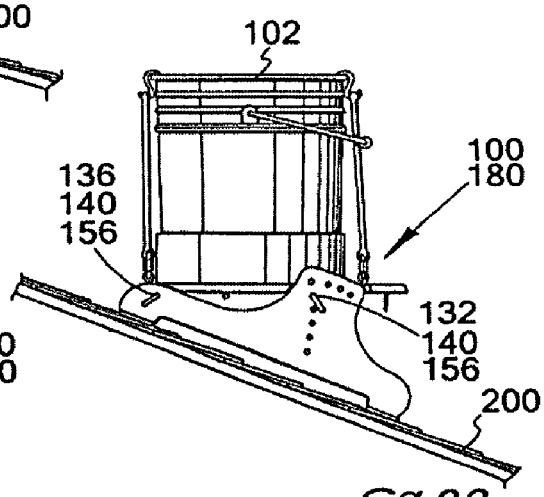
FIG. 23 depicts a side view of the all terrain material and tool tray 100 of this invention on a fifth roof 200 in plumb position 180.
Figure 24:
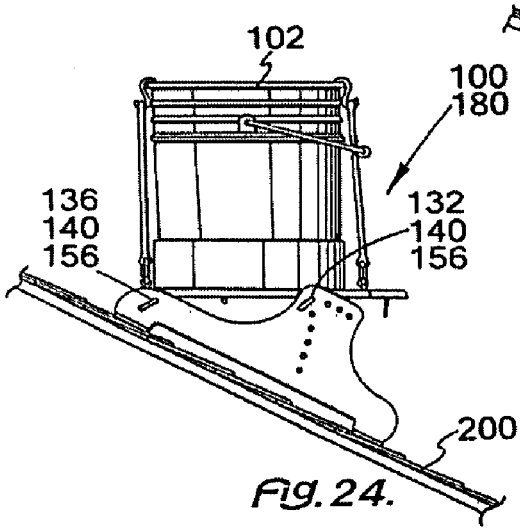
FIG. 24 depicts a side view of the all terrain material and tool tray 100 of this invention on a sixth roof 200 in plumb position 180.
Figure 25:
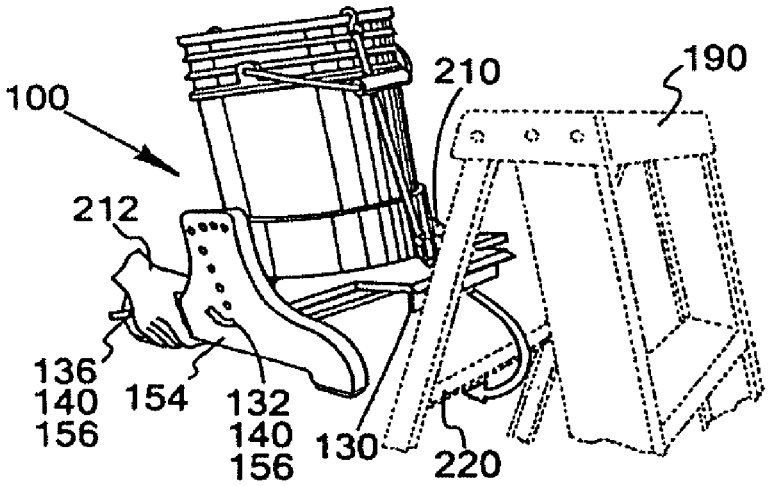
FIG. 25 depicts a perspective view of the reinforced all terrain material and tool tray 100 of this invention being mounted and positioned on a ladder 190.
Figure 26:
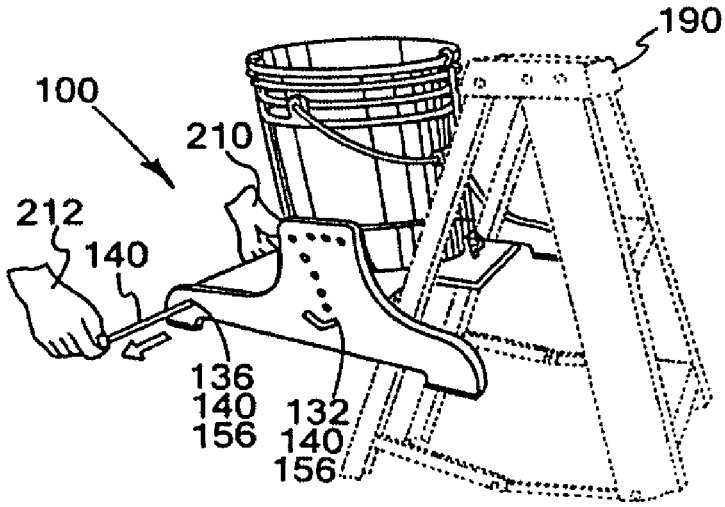
FIG. 26 depicts a second perspective view of the reinforced all terrain material and tool tray 100 of this invention being mounted and positioned on a ladder 190.
Figure 27:
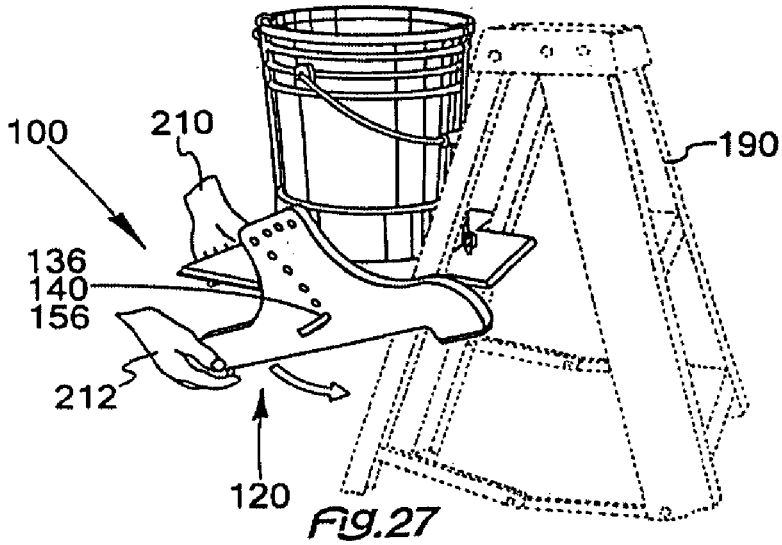
FIG. 27 depicts a third perspective view of the reinforced all terrain material and tool tray 100 of this invention being mounted and positioned on a ladder 190.
Figure 28:
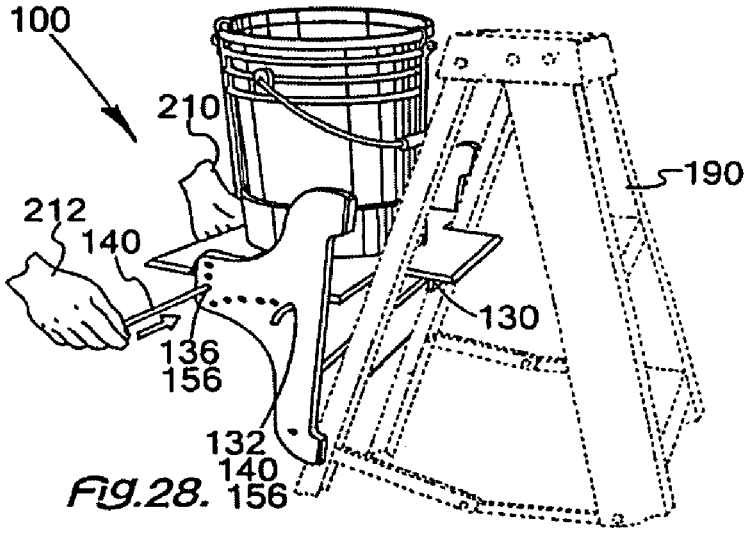
FIG. 28 depicts a fourth perspective view of the reinforced all terrain material and tool tray 100 of this invention being mounted and positioned on a ladder 190.

FIG. 17 and FIG. 18 combine to show all terrain material and tool tray 100 in position on a ladder 190, when a person desires to paint from the ground and use ladder 190 to support bucket 102 or can 104 (FIG. 3). Two of hinge pin 140 are positioned in different pairs of congruent apertures 156; and in two of cleat side pin sleeve 132, center pin sleeve 134 or outboard pin sleeve 136. Then bucket 102, as well as paint can 104 (FIG. 6), can be positioned at a desired angle. Slightly angled as shown in FIG. 16 is used when bucket 102 is substantially full. More angled as shown in FIG. 17 is used when bucket 102 is not substantially full.

Turning now to FIG. 19, FIG. 20, FIG. 21, FIG. 22, FIG. 23, and FIG. 24, all terrain material and tool tray 100 is in use on a roof 200. In most cases, bucket 102 or paint can 104 must be level or horizontal on a roof 200. Two of hinge pin 140 are positioned in different pairs of congruent apertures 156; and in two of cleat side pin sleeve 132, center pin sleeve 134 or outboard pin sleeve 136. Then bucket 102, as well as paint can 104 (FIG. 6), can be positioned at a desired horizontal position.

Figure 35:
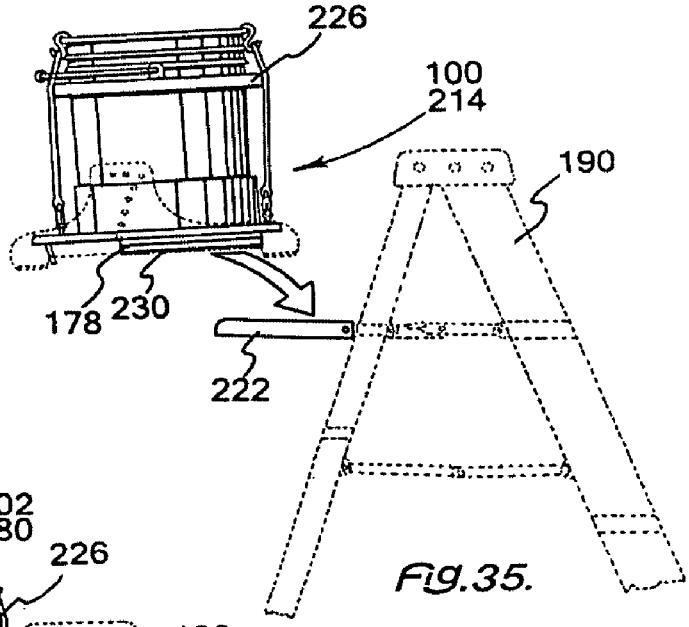
FIG. 35 depicts a side view of the all terrain material and tool tray 100 of this invention on a ladder shelf 222 of ladder 190.

Now considering FIG. 25, FIG. 26, FIG. 27, and FIG. 28, all terrain material and tool tray 100 is installed on a ladder 190 (without a ladder shelf 222 as in FIG. 35). Ladder cleat 130 is placed over cross brace 220 of ladder 190. A hinge pin 140 is removed by first hand 210 with second hand 212 steadying articulating shelf assembly 120 and permitting articulating base assembly 150 to rotate around a second hinge pin 140 to a desired location. The first hinge pin 140 is reinserted through the desired congruent apertures 152 as may be cleat side pin sleeve 132 or center pin sleeve 134. Then ladder cleat 130 and support base member 178 support all terrain material and tool tray 100 on ladder 190.

Horizontal or plumb position 180 as shown in FIG. 15; or as used on a ladder 190 in FIG. 25, FIG. 26, FIG. 27, and FIG. 28; is horizontal of the all terrain material and tool tray 100 relative to a ground surface. Angled or pitched positions 82 of the all terrain material and tool tray 100 is angled relative to a ground surface. No matter what the slope of the surface on which the all terrain material and tool tray 100 is placed congruent apertures 152 can be used to achieve the angled or horizontal position as desired.

Figure 29:
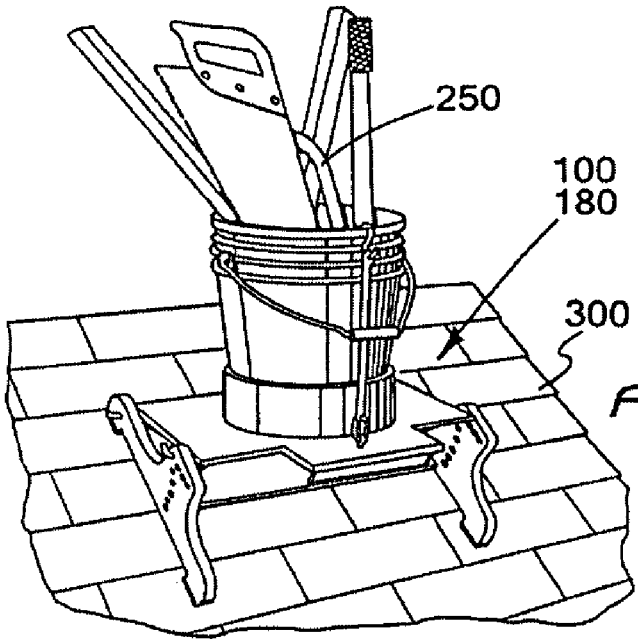
FIG. 29 depicts a perspective view of the all terrain material and tool tray 100 of this invention on an extreme pitch roof 300 in plumb position 180.

With the consideration of FIG. 29, it becomes clear that all terrain material and tool tray 100 can be put in horizontal position relative to level ground plumb position 180 on an extreme pitch roof 300. All that is needed is for first hinge pin 140 to be removed and reinserted through the desired congruent apertures 152 as may be cleat side pin sleeve 132 or center pin sleeve 134.

Figure 30:
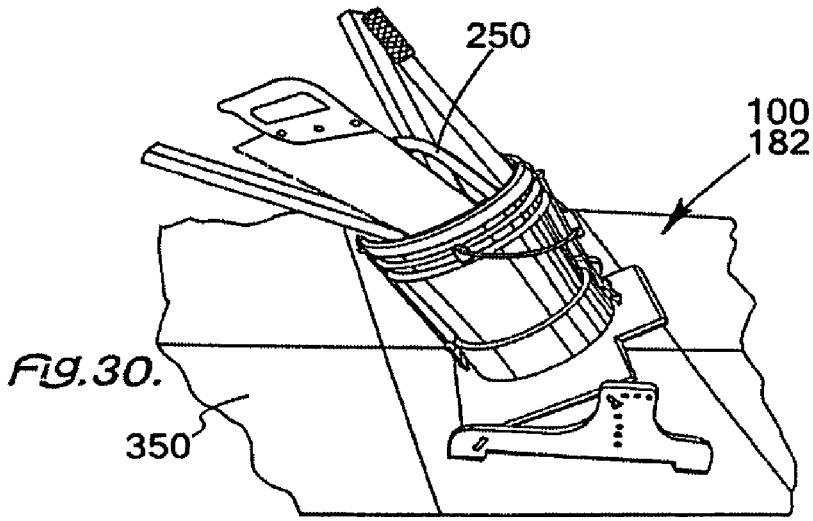
FIG. 30 depicts a perspective view of the all terrain material and tool tray 100 of this invention on a pavement 350.

The adjustment described for FIG. 29 also applies to FIG. 30. All terrain material and tool tray 100 may have plumb position 180 on pavement 350. Pitched position 182, that is angled relative to level ground, is also achievable by selecting a different pair of congruent pin apertures 156 as shown in FIG. 30. All terrain material and tool tray 100 remains stable in extreme pitch position 182, while loaded with top-heavy tools 250.

Thus, articulating shelf assembly 120 and articulating base assembly 150 cooperate so that articulating shelf assembly 120 may have plumb position 180 or pitched position 182, no matter what the position of the articulating base assembly 150 is. This flexibility is accomplished by the cooperation of hinge pin 140 being removed, and then being reinserted through the desired congruent apertures 152

Figure 31:
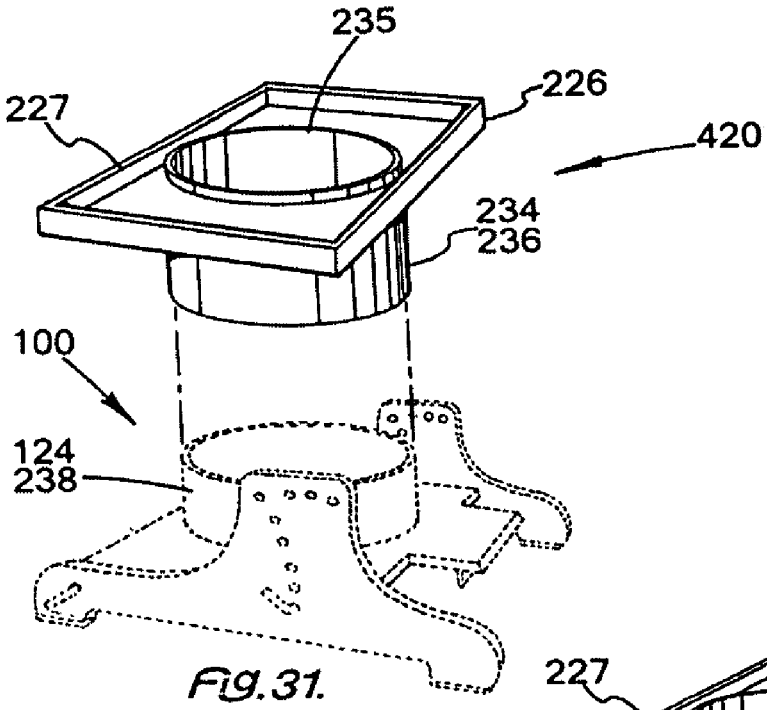
FIG. 31 depicts a perspective view of the all terrain material and tool tray 100 of this invention receiving a no spill surface table 420.
Figure 32:
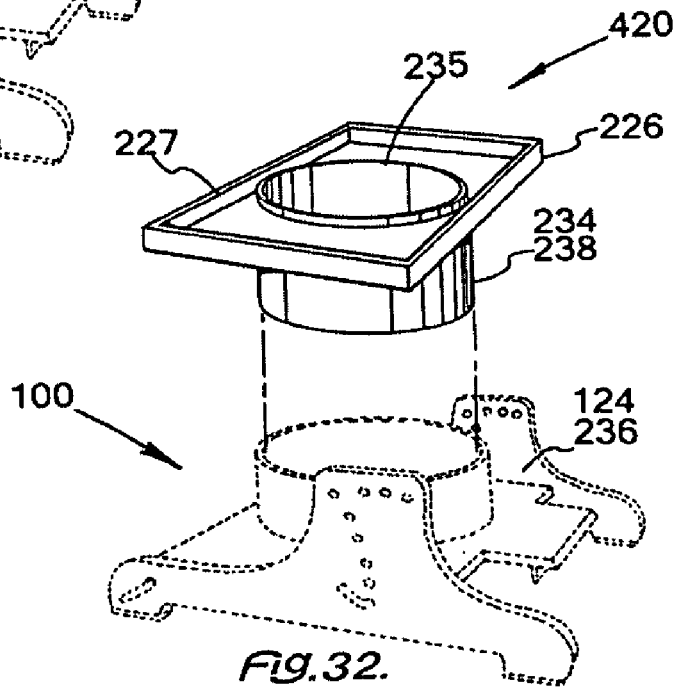
FIG. 32 depicts a perspective view of the all terrain material and tool tray 100 of this invention receiving a no spill surface table 420.

FIG. 31 and FIG. 32 combine to show some effective uses of the all terrain material and tool tray 100. In FIG. 31 with table base collar 234 having a greater diameter 236 than the lesser diameter 238 of bucket collar 124, base collar 234 is in a female to male relationship with bucket collar 134. Alternatively, in FIG. 31 with table base collar 234 having a lesser diameter 238 than the greater diameter 236 of bucket collar 124, base collar 234 is in a male to female relationship with bucket collar 134. Either structure is operable.

Surface table 420 is mounted on table base collar 234. Around the perimeter of surface table 420 is a table spill fence 227, which assists in keeping items (shown in FIG. 33 and other Figures) on surface table 420. Likewise, around table base collar 234 is collar spill fence 235 for the same purpose.

Figure 33:
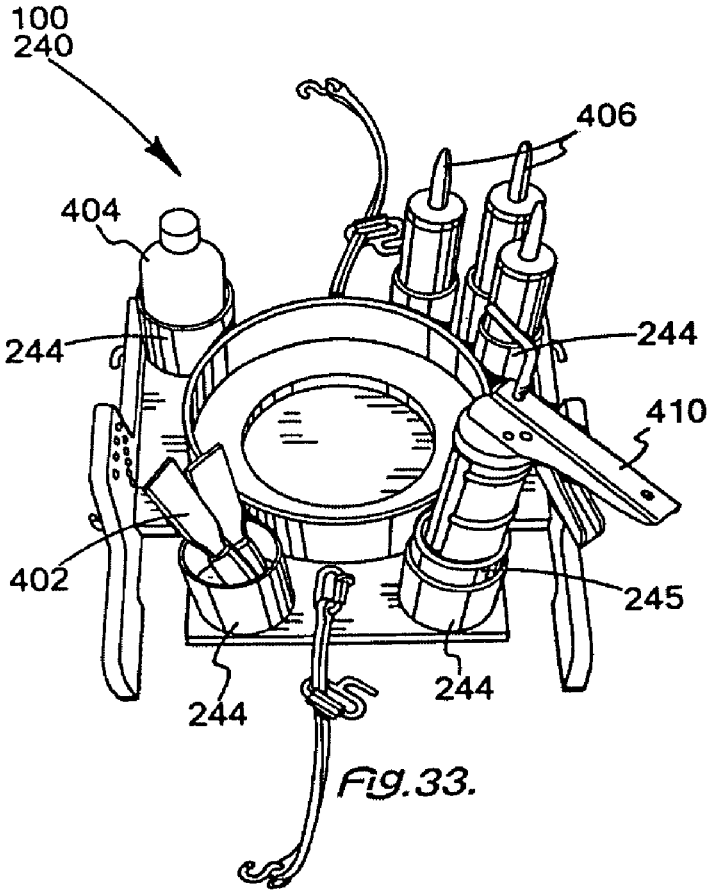
FIG. 33 depicts a top perspective view of the all terrain material and tool tray 100 of this invention.

FIG. 33 shows all terrain material and tool tray 100 modified with a tool carrier assembly 240. Tool carrier assembly 240 modifies articulating shelf assembly 120 with at least, and preferably a plurality of tool containers 244. Each tool container 244 is preferably cylindrical in nature and holds a variety of items. Typical items are putty knife 402, water bottle 404, caulk tube 406 and caulk gun 410. Other items may also be place each of tool containers 244.

Figure 34:
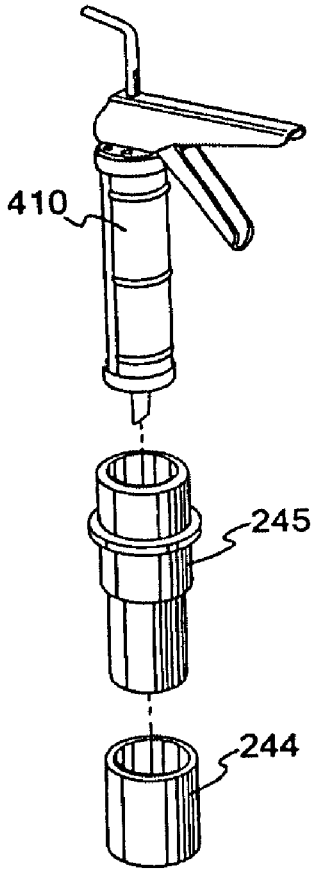
FIG. 34 depicts an exploded view of a tool insert 245 for use with the all terrain material and tool tray 100 of this invention.

Adding FIG. 34 to FIG. 33, a tool insert 245 may be placed in tool container 244. Tool container 244 receives tool insert 245 in a male to female or female to male relationship. Tool insert 245 as shown receives a caulk gun 410, or other desired tool.

Figure 36:
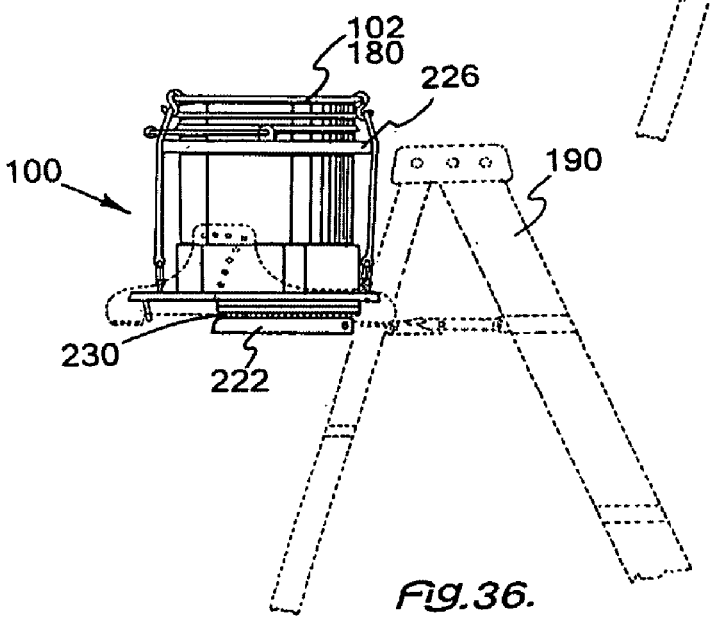
FIG. 36 depicts a side view of the all terrain material and tool tray 100 of this invention on a ladder shelf 222 in plumb position 180.
Figure 37:
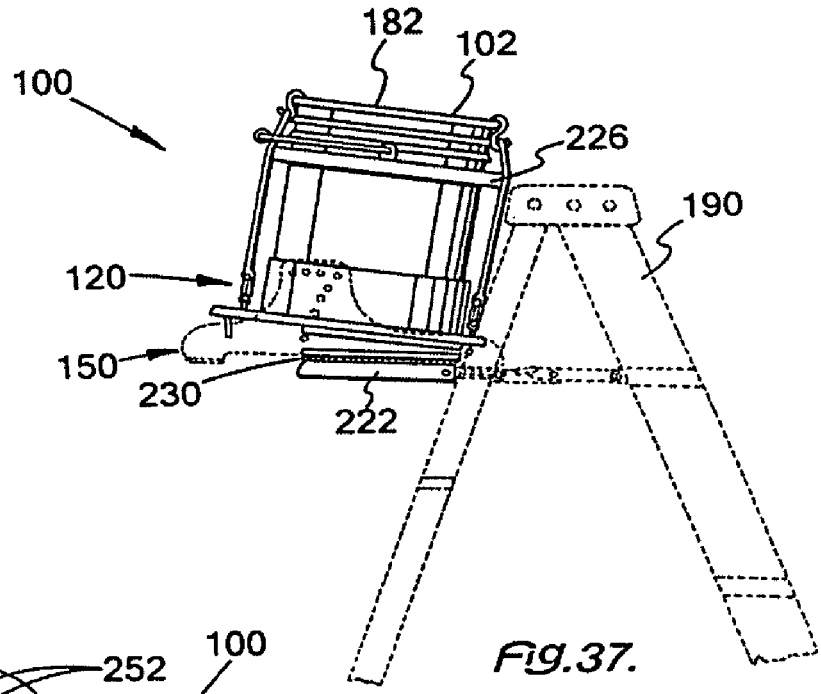
FIG. 37 depicts a side view of the all terrain material and tool tray 100 of this invention on a ladder shelf 222 in angled position.

When it is desired to use all terrain material and tool tray 100 of this invention on a ladder shelf 222 of ladder 190 as in FIG. 35 and FIG. 36, it is especially advantageous to secure a gripping rubber pad 230 to support base 178. With gripping rubber pad 230 on support base 178, all terrain material and tool tray 100 clearly has a more secure position on the ladder shelf 222. As shown in FIG. 37, plumb position 180 and pitched position 182 are also achievable.

Ladder 190 is preferably a standard step ladder, with ladder shelf 222 being a standard foldable tray. Such is the normal construction of a step ladder. All terrain material and tool tray 100 can also be used on other ladders, including but not limited to extension ladders (not shown). Such functionality is made possible by the cooperation of articulating shelf assembly 120 and permitting articulating base assembly 150 as set forth above.

Figure 38:
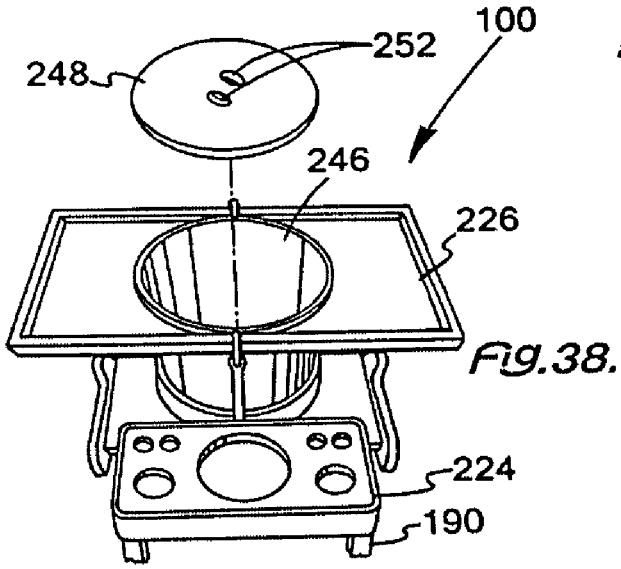
FIG. 38 depicts a top perspective view of the all terrain material and tool tray 100 of this invention with a plug work area 248.

As shown in FIG. 38, ladder 190 can also have all terrain material and tool tray 100 mounted on ladder top 224. Tool bucket 246 may be left open or be closed by plug work area 248, fitting into the top thereof. With plug work area 248 in place, a larger work surface is achieved for work table 226. Optional blind apertures 252 in plug work area 248 facilitate mounting and removal thereof.

Figure 39:
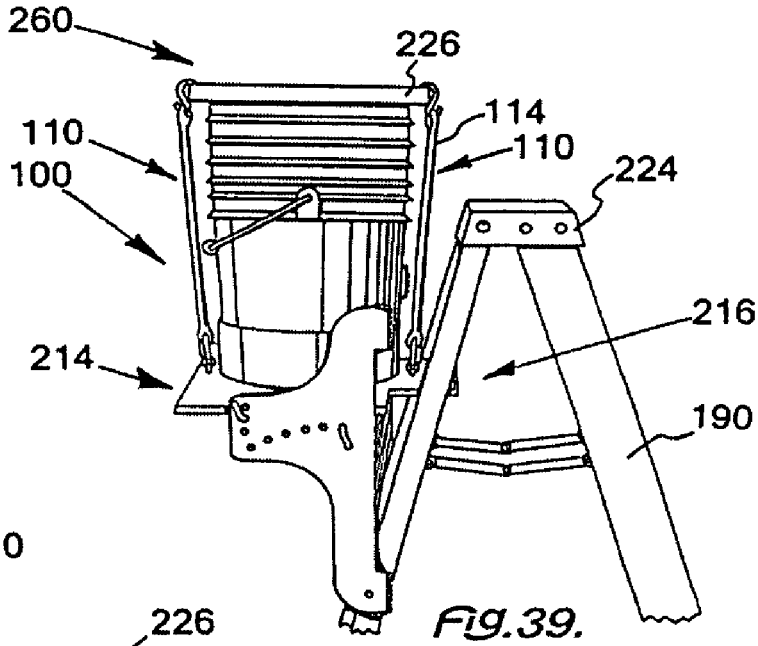
FIG. 39 depicts a side view of the all terrain material and tool tray 100 of this invention with an extended height tray 260.
Figure 40:
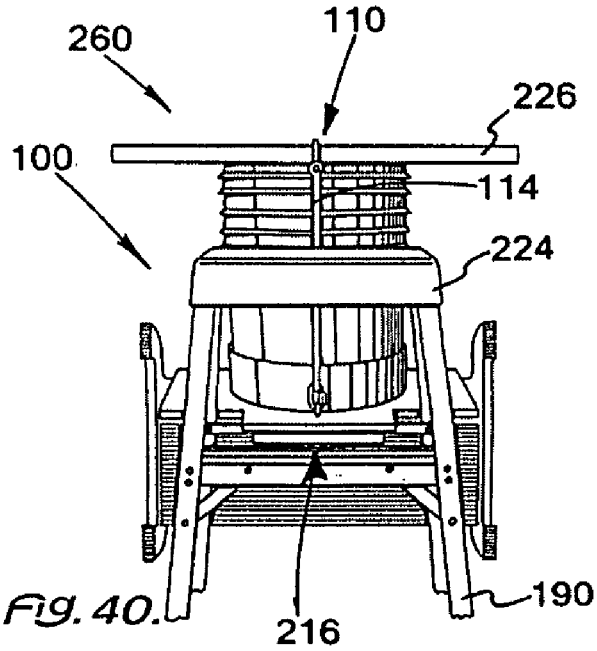
FIG. 40 depicts a back plan view of the all terrain material and tool tray 100 of this invention with an extended height tray 260.

With FIG. 39 and FIG. 40, the all terrain material and tool tray 100 has an extended height tray 260 for work table 226. Such a height adjustment is advantageous in certain situations. Bunge assembly 110, as seen from the rear side 216 of work table 226 provides the stable platform. Two of bunge strap 114 contribute to this strength.

Thus, all terrain material and tool tray 100 has a number of useful functions. These functions are easily accessed and used as described above. The cooperation of these functions solves many problems, especially in the construction industry.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. An all terrain material and tool tray being adjustable between a plumb position and a pitched position, the all terrain material and tool tray comprising:

an articulating shelf assembly being mounted on an articulating base assembly;

the articulating shelf assembly including a shelf panel;

the shelf panel including a means for holding a container on the shelf panel;

the articulating base assembly supporting the articulating shelf assembly in the pitch position or the plumb position;

the articulating shelf assembly being movable relative to the articulating base assembly between the pitch position and the plumb position;

the means for holding a container including a can collar surrounded by a bucket collar;

the means for holding a container further including a bungee assembly;

the bungee assembly releasably joining the container to articulating shelf assembly;

the bucket collar being adapted to receive a bucket;

the can collar being adapted to receive a can;

the bungee assembly being at least two of the bungee assembly supporting the container;

the articulating shelf assembly being placeable at a desired angle relative to the articulating base assembly in order to facilitate use thereof;

the all terrain material and tool tray being removably mounted on a ladder a roof, or a work surface;

the shelf panel including a pair of opposed eyelets to receive the bungee assembly;

the bungee assembly adapted to hold the can in the can collar or the bucket in the bucket collar;

the shelf panel having rectangular cleat panel extending therefrom;

the rectangular cleat panel having smaller sides than the shelf panel;

a ladder cleat being secured to the cleat panel on a side thereof oppositely disposed from the pair of opposed eyelets;

a cleat side pin sleeve being secured to the shelf panel adjacent to the ladder cleat;

an outboard pin sleeve being secured to the shelf panel;

a center pin sleeve being secured to the shelf panel therebetween;

the cleat side pin sleeve, the outboard pin sleeve and the center pin. sleeve being substantially parallel;

the articulating base assembly including a left panel and a right panel;

a support base being secured between the left panel and the right panel as part of the articulating base assembly;

the left panel and the right panel being similar in structure as a substantial mirror image;

the left panel and the right panel each having a footed portion and a raised portion;

the footed portion being adjacent to the support base;

the raised portion including a series of pin apertures;

the cleat side pin sleeve receiving a cleat hinge pin;

the footed portion including a cleat aperture adjacent to the ladder cleat;

the cleat aperture and the cleat side pin sleeve receiving the cleat hinge pin;

the footed portion including an outboard aperture oppositely disposed from the cleat aperture; and the outboard aperture cooperating with the outboard pin sleeve to selectively receive an outboard hinge pin.

2. The all terrain material and tool tray of claim 1 further comprising:

a) each of the series of pin apertures in the left panel having a pair of matching apertures with each of the series of pin apertures in the right panel; and b) a center hinge pin cooperating with the center pin sleeve and the pair of matching apertures to position the articulating shelf assembly relative to the articulating base assembly.

3. The all terrain material and tool tray of claim 2 further comprising:

a) the series of pin apertures substantially forming an outline of the Arabic numeral seven;

b) the footed portion having at least one rubber pad on a bottom portion thereof, in order to facilitate placing of the all terrain material and tool tray in the desired position; and c) the left panel and the right panel being secured on opposing sides of the support base.

4. The all terrain material and tool tray of claim 3 further comprising:

a) the left panel and the right panel being secured on opposing sides of the support base and substantially perpendicular to the center hinge pin;

b) the articulating shelf assembly being connected to the articulating base assembly by at least one of said cleat pin or hinge pin; and c) the series of pin apertures permitting a desired placement of the articulating shelf assembly relative to the articulating base assembly.

5. The all terrain material and tool tray of claim 4 further comprising:

a) the shelf panel receiving the bucket collar and the can collar;

b) the can collar fitting inside of the bucket collar;

c) the bungee assembly including a flexible strap having a first end and a second end with a hook assembly cooperating with the flexible strap;

d) the hook assembly including a standard locking link at the first end;

e) the hook assembly including a s-hook at the second end; and f) the hook assembly including a hooked locking link slidably mounted on the flexible between the first end and the second end.

6. The all terrain material and tool tray of claim 5 further comprising:

a) the standard locking link cooperating with a member of the pair of opposed eyelets;

b) the s-hook cooperating with the can or the bucket;

c) the hooked locking link facilitating a securing of the can or the bucket as desired; and d) the pair of opposed eyelets being a pair of diametrically opposed eyelets.

7. The all terrain material and tool tray of claim 6 further comprising:

a) a first angle bracket securing the left panel to first side of the base member;

b) a second angle bracket securing the right panel to a second side of the base member;

c) the first angle bracket being substantially parallel to the second angle bracket; and d) the first angle bracket being substantially perpendicular to the ladder cleat.

8. The all terrain material and tool tray of claim 7 further comprising:

a) the articulating shelf assembly being positionable in the pitch position or the plumb position relative to the articulating base assembly independent of a position of the articulating base assembly; and b) the articulating base assembly further including a rubber gripping pad adjacent to the ladder cleat.

9. The all terrain material and tool tray of claim 8 further comprising:

a) the bucket collar receiving a table base collar;

b) the table base collar being in a female to male relationship or a male to female relationship with the bucket collar;

c) the table base collar having a surface table mounted thereon oppositely disposed from the bucket collar;

d) the surface table including a table spill fence bordering the surface table; and e) a collar spill fence around the table base collar on the surface table.

10. The all terrain material and tool tray of claim 8 further comprising:

a) the bucket or the can containing a construction fluid; and b) the construction fluid being at a pitched position or a plumb position.

11. The all terrain material and tool tray of claim 8 further comprising:

a) the articulating shelf assembly further including a tool carrier assembly;

b) the tool carrier assembly including at least one tool container therein; and c) a removable plug closing the table base collar adjacent to the surface table, in order to increase a work area of the surface table.

12. The all terrain material and tool tray of claim 11 further comprising:

a) the at least one tool container being preferably cylindrical in nature;

b) an insert for at least one of the at least one tool container; and c) the bucket collar supporting an extended height tray for the work table.

* * * * *